United States Patent [19]

Wessel

[11] Patent Number: 4,595,226

[45] Date of Patent: Jun. 17, 1986

[54] BALL AND BAT CARRIER

[75] Inventor: Elmer A. Wessel, Lincoln, Nebr.

[73] Assignee: Industrial Machine Specialties, Inc., Lincoln, Nebr.

[21] Appl. No.: 669,098

[22] Filed: Nov. 7, 1984

[51] Int. Cl.[4] ..... B65D 19/00

[52] U.S. Cl. ..... 294/146; 294/143

[58] Field of Search ..... 294/146, 143, 159, 161, 294/162, 147, 148, 160, 163, 165, 166, 168, 170; 211/60 R, 60 G, 60 T, 62, 64, 68, 69; 224/913, 922

[56] References Cited

U.S. PATENT DOCUMENTS 3,079,967 3/1963 Noel ..... 294/146

4,036,416 7/1977 Lowe ..... 294/143

*Primary Examiner*—James B. Marbert

*Attorney, Agent, or Firm*—Vincent L. Carney

[57] ABSTRACT

To permit ready transportation of equipment for a baseball game to the field and hold it in ready condition during a game, a ball and bat carrier has a wire frame with: (a) an enclosed general storage area centrally located; (b) ball holders on either end of the enclosed general storage area; (c) a bat storage section in front of the enclosed general storage area; and (d) a game bat rack near the bottom of the ball and bat carrier. The ball and bat carrier may be mounted on a wire fence at the ballpark and the ball bats removed from a secure storage position to a more readily available hanging position on the game bat rack. Other items may be stored in the enclosed general storage area such wallets or the like during the game.

10 Claims, 13 Drawing Figures

150
152
154
156
110D
138B
140A
120A
110E
112E
138A
178
166A
170A
166B
170B
166C
170C
166D
170D
166E
170E
166F
170F
166G
170G
166H
170H
166I
170I
180
162A
162B
162C
162D
162E
162F
162G
162H
162I
168A
168B
168C
168D
168E
168F
168G
168H
168I
159
160
182
184
12

BALL AND BAT CARRIER

BACKGROUND OF THE INVENTION

This invention relates to ball and bat carriers.

Ball and bat carriers are known for transporting balls and bats to the field and for permitting them to be available in the field.

In one prior art type of baseball equipment holder, the equipment is carried in a bag and removed for use at the field for use. Bat racks which can be hung from a fence are known for mounting the bats.

The prior art baseball equipment holder and bat rack have several disadvantages, such as: (1) the rack only holds bats; (2) if a large amount of equipment such as that for a team are used, they are too clumsy to carry and not readily available at the field.

SUMMARY OF THE INVENTION

Accordingly, it is an object of the invention to provide a novel ball and bat carrier.

It is a still further object of the invention to provide a light-weight, compact ball and bat carrier;

It is a still further object of the invention to provide a light-weight, easy to carry and hangable ball and bat carrier.

In accordance with the above and further objects of the invention, a ball and bat carrier is formed to a large extent of wire members welded together with at least half of the combined total length of the wire members having a diameter of between ⅛ inch and ½ inch. The ball and bat carrier includes at least a ball holder, and a bat holder and is formed at least 80% of the ball and bat carrier are wire members.

The ball holder for balls, such as baseballs or softballs, is in the form of a column of sufficient size to receive balls at the top and hold them one on the other while permitting their removal one at a time at the bottom of the column. The storage section for bats holds them during movement of the ball and bat carrier from place to place and a game bat rack holds them more readily available for removal during the game. Hook members permit the the ball and bat carrier to be hung on a fence with the bat rack extending outwardly for easy access.

Advantageously, the hook members are above the center of gravity of the ball and bat holder and formed of wire. The bat storage section includes wire holders for holding the bats substantially horizontally at two points and the game bat holding rack used during the game includes outwardly extending wire fingers for holding the bat flange near the bat grip so as to hang the bats by the flange.

To manufacture the ball and bat holder, standard circles and rectangles and straight segments are purchased and wire subsections welded together while held in fixtures. The subsections are assembled and welded together to form the ball and bat carrier. Advantageously, substantially the entire assembly is wire and thus only requires resistance welding equipment for welding small spots using amperage of between 1,000 (momentary resistance) and 40,000 amperes.

From the above description, it can be understood that the ball and bat rack of this invention has several advantages such as: (1) it is light in weight and easy to carry; (2) equipment can be carried and stored securely and conveniently; (3) equipment can be unpacked and held by the ball and bat rack during a game in convenient position; and (4) it can be used to store other valuables during a game.

SUMMARY OF THE DRAWINGS

The above-noted and other features of the invention will be better understood from the following detailed description when considered with reference to the accompanying drawings in which.

DETAILED DESCRIPTION

Figure 1:
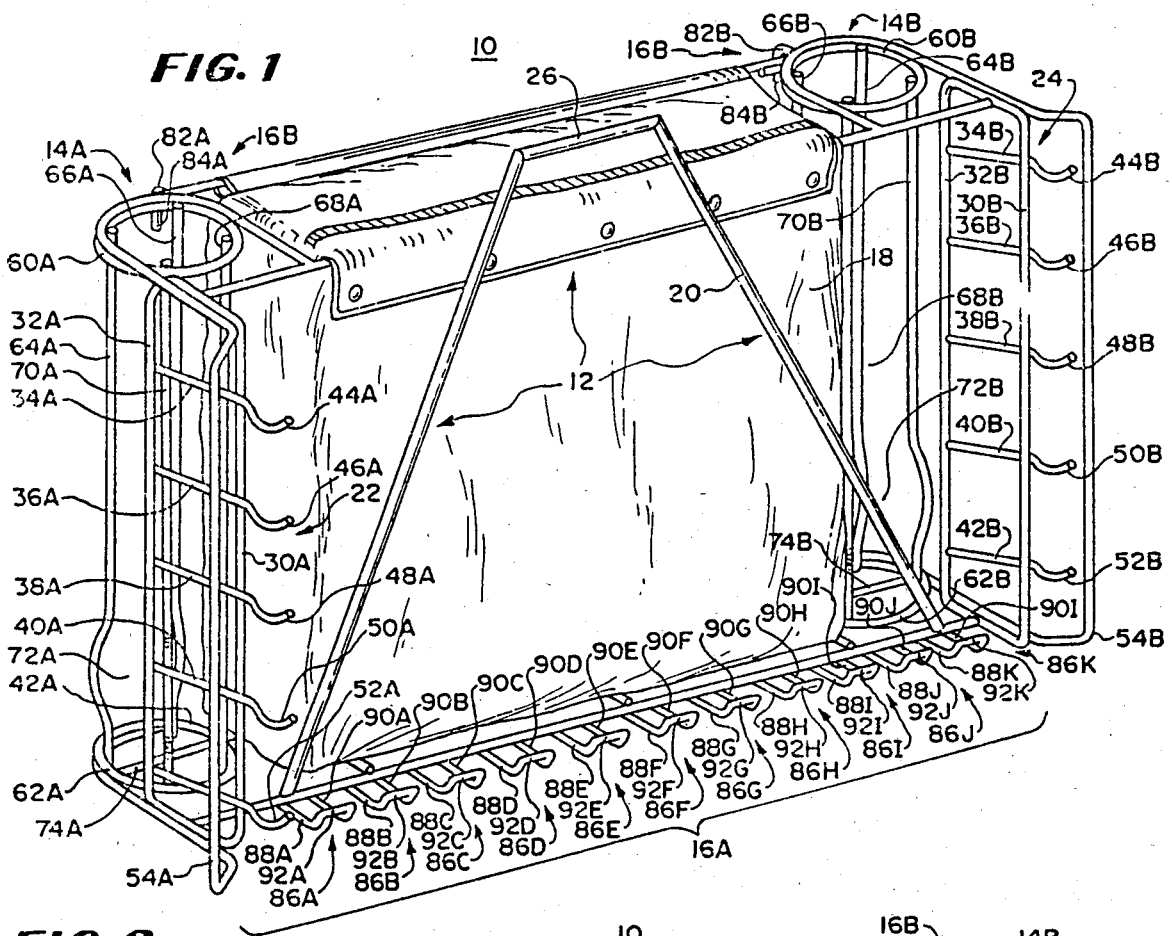
FIG. 1 is a perspective view of an embodiment of the invention.

In FIG. 1, there is shown a perspective view of a bat and ball carrier 10 having a general storage area 12, two ball holder sections shown generally at 14A and 14B, a game bat rack section shown generally at 16A and and a game holder section 16B. The general storage area 12 is centrally located and integrally connected to the ball holder sections 14A and 14B which are on the left and right-hand sides of it respectively and to the game bat rack section 16A and game holder section 16B which are located diagonally with respect to it.

The general storage section 12 includes a central main storage area 18, a handle 20 and right and left bat holders shown generally at 22 and 24. The main storage area 18 may be used to bring any items to the park or to store any items while the bat holder sections 22 and 24 each receive one end of each of several bats for storage while bringing them to the game, the handle 20 permits convenient carrying of the entire apparatus to and from the ball park in a balanced position, with all of these parts being part of one relatively rigid ball and bat carrier.

The main central storage area 18 is a compartment in the preferred embodiment which may be surrounded or partly surrounded and measures 18¾ inches deep, 18½ inches long and 5 inches wide in the preferred embodiment. The dimensions may vary to correspond with the necesary equipment to be carried such as for example different sizes of bats may permit different sized carriers. It may include a casing of nylon or simply a wire skeleton or a plastic basket or the like.

The compartment should be between 3 inches and 8 inches in width, between 8 inches and 24 inches deep, and between 8 inches and 36 inches long. It should have sufficient space to store the items being carried to the ball park and the two sides of the bat holder should be spaced far enough apart to support the bats.

The handle 20 in the preferred embodiment is entirely of wire and welded at its bottom ends to the outer edges of the frames adjacent to the ball holders 14A and 14B and to a strut which supports the game bat rack section 16A at the bottom, extending upwardly and inwardly to a top grip portion 26 which is horizontal in its normal position and sufficiently large to fit in a hand, being at least 3 inches long. The downward struts spread outwardly until they span almost the entire distance across the base of the ball and bat carrier 10. The distance between the grip portion 26 and the bottom of the ball and bat carrier furthest from it should be between 36 inches and 12 inches and the distance between the grip portion 26 and the top of the ball and bat holder closest to it must be at least three quarters of an inch.

The left side bat holder 22 includes includes two left-side vertical posts 30A and 32A parallel to each other and the right bat holder includes corresponding right-side vertical posts 30B and 32B also parallel to each other. The posts 30A, 30B, 32A and 32B extend from top to bottom of the ball and bat holder 10 and the pairs on each side are spaced from each other a sufficient distance to receive the wide part of a bat. Extending horizontally between the left-side posts 30A and 32B are a plurality of horizontal cross support members, there being five such members 34A, 36A, 38A, 40A and 42A in the preferred embodiment and extending between the right-side posts are corresponding five cross support members 34B, 36B, 38B, 40B and 42B between the posts 30B and 32B welded thereto and adapted to receive the wide hitting portions of bats for support thereon.

In the preferred embodiment, the horizontal cross support members 34A–42A and 34B–42B are each a single wire although in other embodiments, there may be two wires. In the preferred embodiment, each of the horizontal cross support members 34A–42A and 34B–42B ends in a corresponding hook having a radius of curvature adapted to support the neck of a bat. The hooks for the left-hand side are indicated at 46A, 48A, 50A, 52A and 54A and on the right-hand side by corresponding members 46B, 48B, 50B, 52B and 54B. There should be at least three such hooks on each end and no more than eight on each end.

In the preferred embodiment, the distance between the posts 30A and 32A and between the posts 30B and 32B are each two and three quarter inches and the distance between the horizontal support members such as 34A, 36A, 38A, 40A and 42A and the corresponding horizontal support members 34B, 36B, 38B, 40B and 42B are 3.25 inches from adjacent members. The distance between the posts such as 30A and 32A and the posts 30B and 32B and the distance between the adjacent ones of the members 34A–42A and 34B–42B should be more than 2 inches and less than 4½ inches. The distance between opposite supports such as 34A and 34B or 36A and 36B on opposite ends should fall in the range between 18 inches and 36 inches and in the preferred embodiment are 28 inches.

The hooks 44A–52A and 44B–52B in the preferred embodiment have curvature with a diameter of 1.35 inches and the outer end of the curved portion is 1.15 inches the corresponding one of the posts 30A and 30B and should be within the range of ¾ inch and 2¾ inches the end of the part 30A and 30B than 2¾ inches with a diameter of the radius of curvature of between 0.75 and 3 inches.

To prevent the bats from slidng from the bat storage section, a pair of parallel posts, one on the left-hand side 54A and one on the right-hand side 54B are parallel to the corresponding posts 30A and 30B and spaced therefrom a sufficient distance to prevent the flanges of the bats from sliding beyond them. The flanges are captured between the hooks 44A–52A and the post 54A and betwen the hooks 44B–52B and the post 54B. For this purpose, the posts 54A and 54B are spaced from their corresponding parallel members 30A and 30B a distance of between ½ inches and 2.3 inches and are in a plane making a 56 degree angle with the vertical plane forming the side of the ball and bat rack. In the preferred embodiment the space is 1½ inches.

The right and left ball holder sections 14A and 14B are substantially identical except that their openings at the bottom face an opposite direction to permit removal of balls from either the left or the right side. Only the left-hand ball holding section 14A will be described here.

The ball holder 14A includes top and bottom toroids or wire circles 60A and 62A respectively separated by four circumferentially spaced vertical supports 64A, 66A, 68A and 70A extending between the two circles to form columns with the ends of the supports being attached to the circles 60A and 62A at circumferentially spaced distances and being sufficiently close together to confine a ball within them, there is one lower opening in each ball holder at the outer sides of the ball holder formed by columns bent outwardly. In the left ball holder, the opening is at a location where the two supports 64A and 70A are bent apart to form a circular outlet near the bottom circle 62A. A bottom wire 76A extends diametrically across the bottom circle 62A to prevent balls from dropping through the bottom circle 62A.

The right-hand ball holder 14B has parts correspondently numbered except that the circumferentially spaced column supports are numbered in a counterclockwise rather than a clockwise direction looking from the top in FIG. 1. In the preferred embodiment, the ball holders 14A and 14B are the same size to receive the same size balls but they may be of different sizes so that one end may be designed to carry larger balls than the other or only one need be included. Other circles may be included in a ball holder between the top and bottom circles for additional support but when not used, the wires must be at least ⅛ inch in diameter. The diameters of the circles 60A, 60B, and the circles 62A and 62B should be between 1½ inches and 5 inches in diameter. The openings 72A and 72B should have diameters of between 1¼ inches and 3½ inches.

The game bat rack sections 16A and 16B are two hooks spaced separated from and aligned with each other horizontally from side to side and extending rearwardly parallel to each other from a top framing wire 80. The left-side hook includes a horizontally extending portion 82A and the right-hand hook includes a parallel similar portion 82B. Each of the portions 82A and 82B have downwardly extending portions 84A and 84B respectively parallel to each other.

In the preferred embodiment, the members 82A are ¾ inch long to the center of the wire and the downwardly extending portions 84A and 84B are each 1½ inches long. The maximum length of the hook members 82A and 82B should be 5 inches and the minimum ½ inch and the minimum length of the downwardly extending portions 84A and 84B should be ½ inch and the maximum 5 inches.

The game section 16A includes a plurality of fingers extending outwardly and upwardly to receive in slots between pairs of them the flanges at the end of the grip of bats so that bats may be depended therefrom. In FIG. 1, eleven such fingers are shown, but in the preferred embodiment, nine are used, the nine having spaces or slots between fingers of 1½ inches to receive the grip portion of the bats with the flanges at the end overhanging them. Each finger indicated at 86A–86K includes a corresponding first wire member 88A–88B and a corresponding wire member adjacent to it and parallel thereto 90A–90K. The two members being bent upwardly at their ends and connected by a corresponding one of the members 92A–92K which are aligned with each other.

In the preferred embodiments, alternate ones of the fingers 86A–86K have wire members 90A–90K which are 1½ inches long and the wire members between these alternates are 1 inch long. The space between each finger is 1½ inches so that 1½ inch are available to receive the grip part of a bat while the flanges have half the distance of either the 1½ inch wide supports or the 1 inch wide supports.

Generally, the distance between fingers 86A–86K should be between ¾ inch and 2¾ inches. The space on the support areas of the fingers 86A–86K to support the flanges of the bats should be between ¼ inch and 2 inches. Alternate ones of the fingers 86A–86K have their parallel wire members 88A–88K and 90A–90K extending fully across the rack and welded at the bottom to form a wire bottom support on the rack. Two of them may extend across the bottom circles 62A and 62B to prevent balls from falling through instead of a single wire separately welded.

Figure 2:
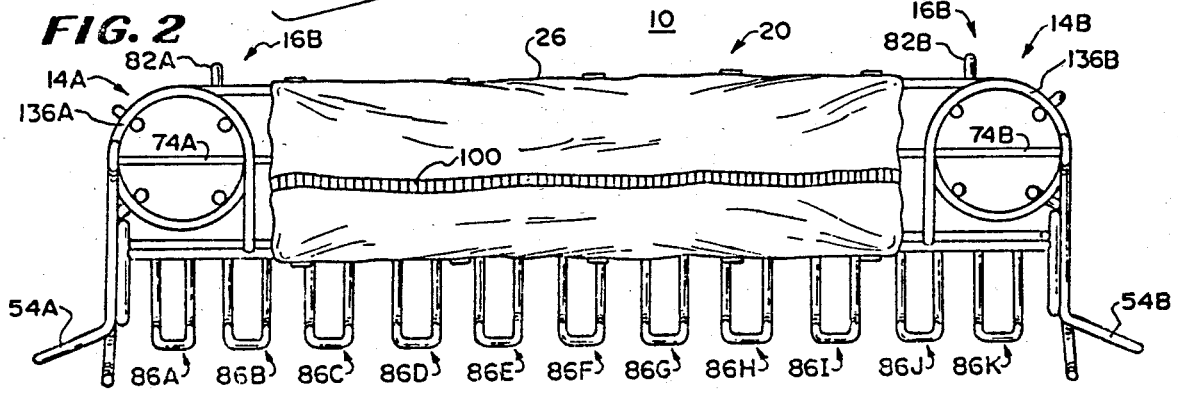
FIG. 2 is a top view of the embodiment of FIG. 1.

In FIG. 2, there is shown a top elevational view illustrating the manner in which: (1) the game bat racks support fingers 86A–86K extend outwardly so that the flanges at the end of the bats may be placed on top of two adjacent fingers during a game with the bat grip in slots between fingers; and (2) when stored, the bats may be criss-crossed across opposite bat holders with the possible sliding action of the bats being restrained by the wire members 54A and 54B. The top of the storage compartment has a plastic container in it which may be unzipped by a zipper shown at 100 to insert or remove items.

Figure 3:
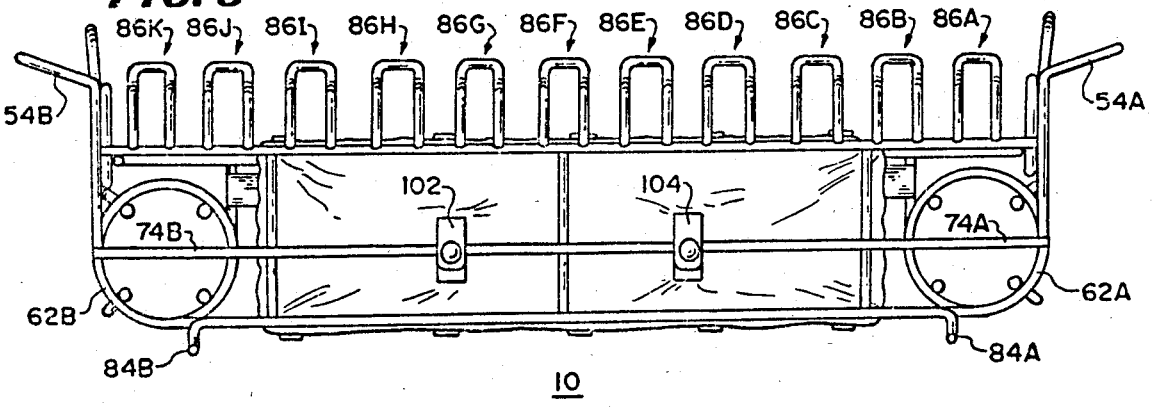
FIG. 3 is a bottom view of the embodiment of FIG. 1.

In FIG. 3, there is shown a bottom view of the ball and bat carrier 10 showing snaps 102 and 104 for holding the a container within the wire storage area by snapping over a support member of the wire frame. The support member in this embodiment includes the wire 74A and 74B and extends longitudinally along the rack. As best shown in this view, balls are prevented from falling through the bottom by support members 74A and 74B although in another embodiment, the end units 86A and 86K extend across the bottom so as to form two members crossing the circles 62A and 62B and prevent balls from falling through the bottom.

Figure 4:
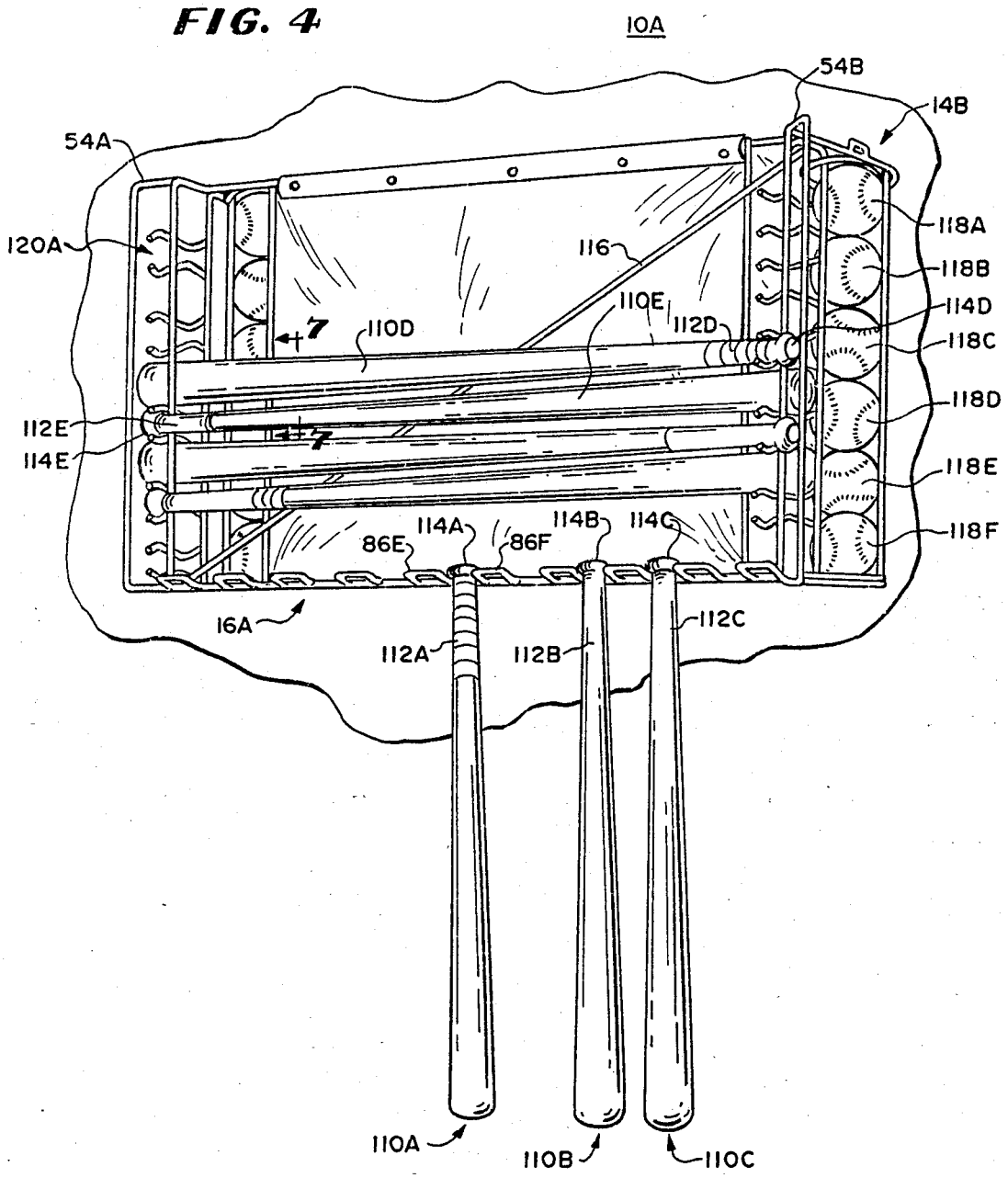
FIG. 4 is a perspective view illustrating the use of the invention during a game.

In FIG. 4, there is shown a simplified perspective view of another embodiment 10A of a ball and ball holder, which embodiment differs from the embodiment 10 of FIG. 1 in that: (1) a support 116 diagonally crosses the frame on the back in this embodiment but not in the embodiment of 10; and (2) instead of the single hooks 44A–52A and 44B–52B of the embodiment 10 of FIG. 1 pairs of clip members such as 120 are used to hold the grip portions of bats. In the embodiment of 10A, the support 116 is a substitute for the support provided by the handle 20 and a separate strap (not shown in FIG. 4) is used instead.

As shown in FIG. 4, balls such as the balls 118A–118F shown in the right-hand ball holder 14B are stacked one on top of the other, having been inserted in the top. They may be removed from the bottom such as by pulling out ball 118 to the right as shown in FIG. 4 through the open space shown in FIG. 1 at 42B. During the game, bats such as 110A–110C may be depended from the bat storage area 16A.

As described in connection with the bat 110A, the bat has a grip portion 112A and a flange at the end of the grip 114A. During the game, the bats may be removed from the storage section 12 and inserted in the game bat rack section at 16A by sliding the grip portion 112A between the support fingers 86E and 86F so that the flange 114A rests on top of the support fingers 86E and 86F. Alternatively, during movement of the bat and ball carrier 10A or storage, bats may be positioned such as the bats 110E and 110D, each of which also has a corresponding grip portion 112D and 112E and an end portion 114D and 114E.

As shown in FIG. 4, the thick end of the bat which is opposite to the flange 114D, rests on top of the vertical support members, which in the embodiment of FIG. 1, is one of the members 34A–42A to be between two bat grip holding members, one of which is shown at 120A in FIG. 4. The corresponding bat grip supports in the embodiment of FIG. 1 are the hooks 44A–52A and 44B–52B. The supports 120A receive the grip in a spring biased position with a shank extending outwardly from them and prevented from sliding by both a gripping action and by the members 54A and 54B.

The bat 110E adjacent to the bat 110D is positioned oppositely with its grip portion being held by the holder on the left-hand side and its thick portion being inserted on top of the horizontal bat holder member on the right-hand side so that bats 110D and 110E criss-cross each other and are one above the other. Thus, alternate bats positioned vertically to each other are each positioned horizontally with its bat grip and flange on the opposite side of the right and left sides of the rack as the next bat and the bats criss-cross each other along the center at an angle to each other.

Figure 5:
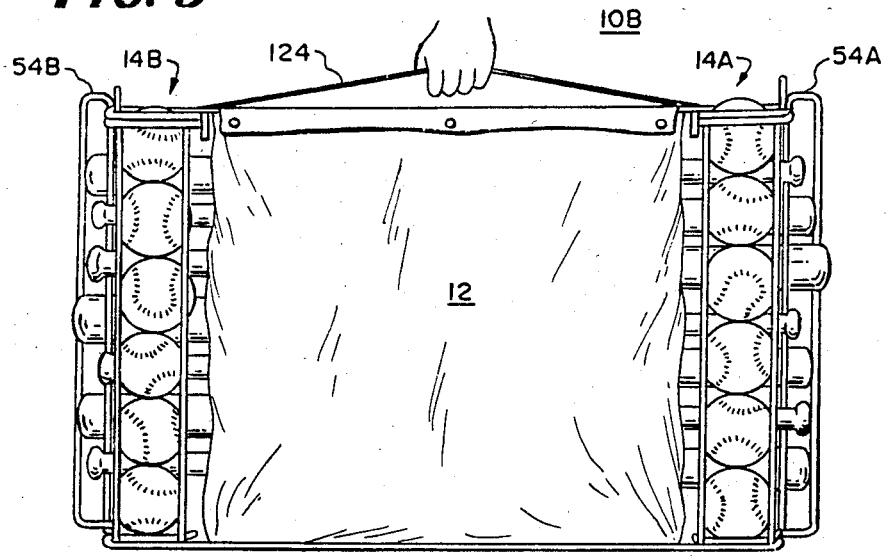
FIG. 5 is a front elevational view illustrating the use of the ball and bat rack during storage.

In FIG. 5, there is shown a rear elevational view of the embodiment 10B of the ball and bat carrier showing the method of carrying it in which the hand holds a strap 124 which is fastened at its opposite ends to structural elements of the ball and bat carrier so that it may be conveniently carried with balls in the ball holders 14A and 14B and the bats stored in the storage area.

Figure 6:
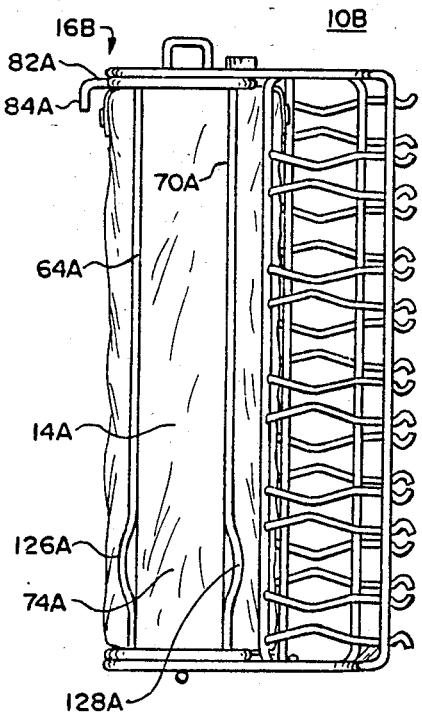
FIG. 6 shows a side view of another embodiment of the invention.
Figure 7:
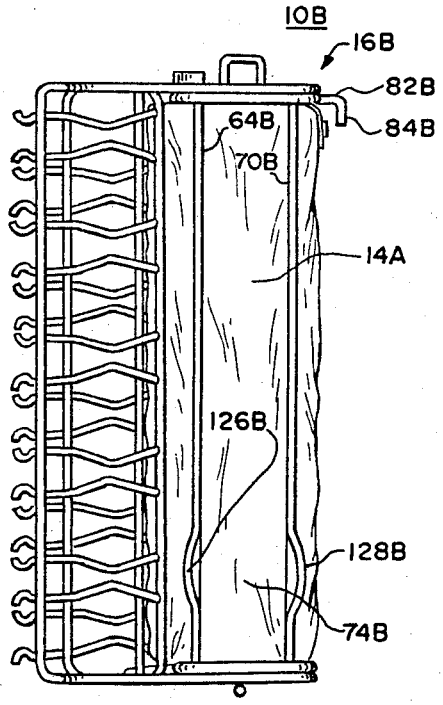
FIG. 7 is a side elevational view of the embodiment of the invention of FIG. 6.

In FIG. 6, there is shown an elevational end view of the ball and bat carrier 10B illustrating the opening 74A for removing balls from the end portion. As shown in this embodiment, this feature which is present in each of the embodiments includes a bent portion 126A in the columnar support 64A and a bent portion 128A in the support 70A sufficiently large to remove a ball and positioned near the bottom so that by lifting and pulling a ball may be removed. In FIG. 7, the corresponding structure 74B is shown for the opposite end illustrating that the balls may be removed from each end without impediment because of bends such as 126B and 128B and the column supports on the end of the ball holders.

Figure 8:
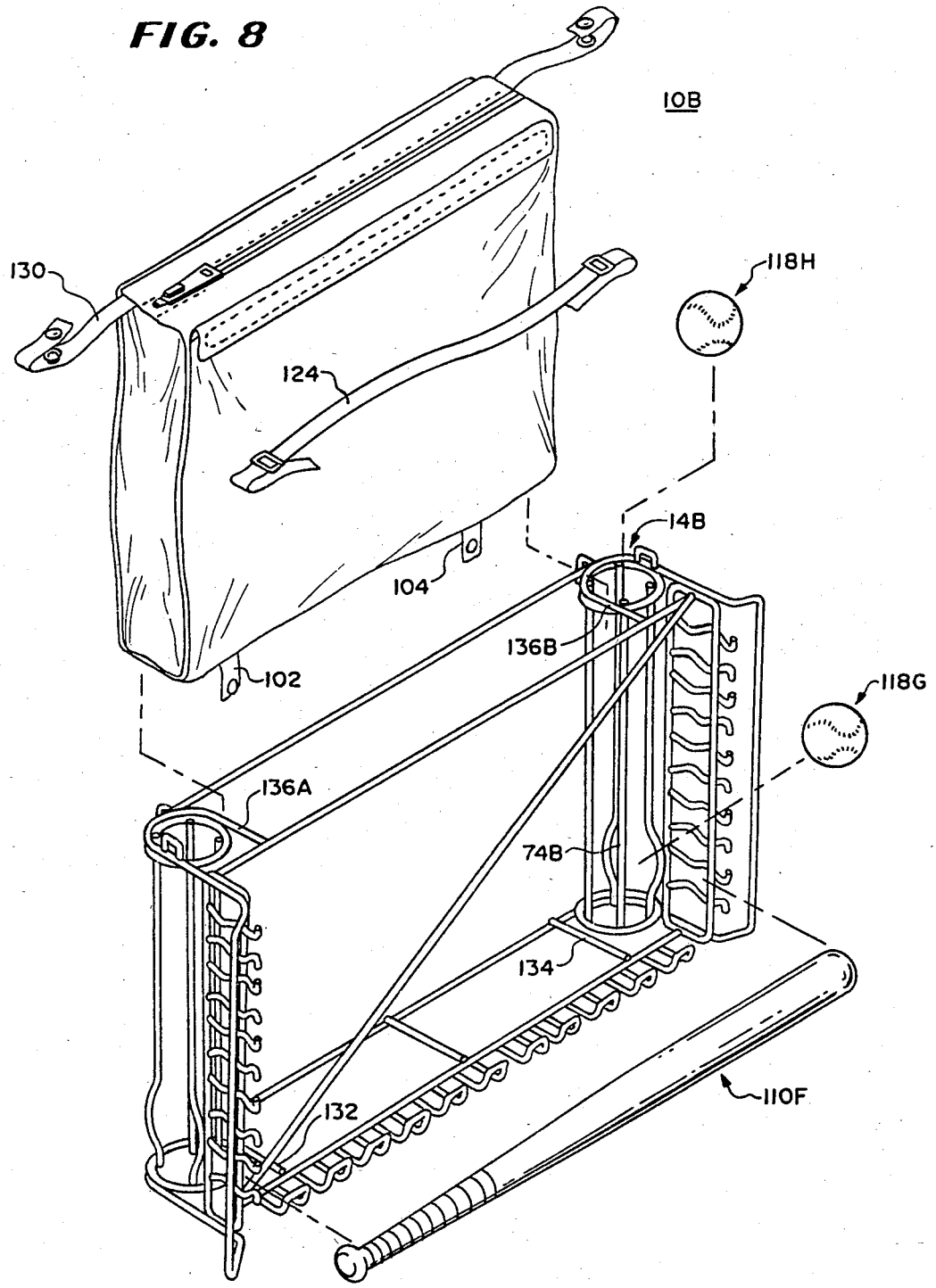
FIG. 8 is an exploded perspective view of the embodiment of the invention of FIG. 6.

In FIG. 8, there is shown an exploded perspective view illustrating the manner in which a ball 118H is inserted into a corresponding ball holder 14B and drops to the bottom. When it is to be removed, a ball such as 118G is removed from the corresponding one of the openings 74B to permit use. Similarly, a bat 110F is held in the storage holders during transportation as shown in this view.

The storage bag is shown having snaps at 130 for holding it to the top, a snap 124 which is fastened to structural elements 136A and 136B of the frame at each end to provide a handle and the snaps 102 and 104 at the bottom to hold the container in place. As mentioned above, the container need not be plastic but may be a wire frame basket or a plastic basket or the like to store in an enclosure suitable materials.

Figures 9, 10, 11, 12, 13:
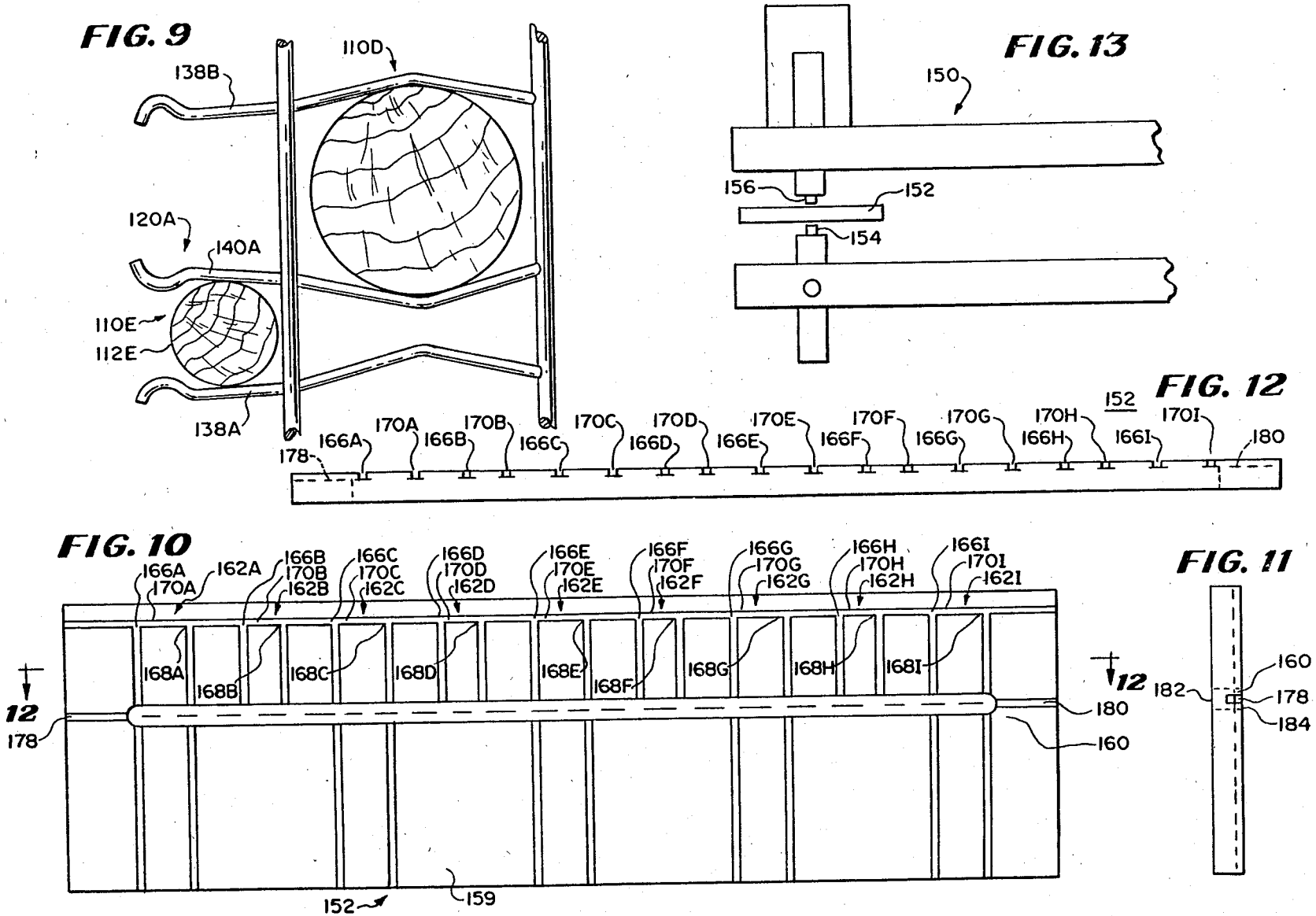
FIG. 9 is a fragmentary elevational view of the bat holder of the embodiment of FIG. 6.
FIG. 10 is a plan view of a fixture for assembling a sub-assembly in accordance with the invention.
FIG. 11 is a left side elevational view of the fixture of FIG. 10.
FIG. 12 is a rear elevational view of the fixture of FIG. 10.
FIG. 13 is a simplified, fragmentary elevational view, illustrating a fabrication operation.

In FIG. 9, there is illustrated a holder 120A having two members 138A and 140A which snap together about the grip 112E of a bat 110E so that its thick portion extends across the opposite side. On the opposite side of the unit, a holder member 138B is shown which will cooperate with another member to receive the shank of another bat. The thick end of the bat 110D above the bat 110E rests on top of the holder 120A. In the embodiment of FIG. 1, the holder 120 of FIG. 9 is placed by a single hook which extends outwardly and holds the grip 112E within it and the thick end of the bat 110 rests on top of its extending member such as the members 34A–42A and 34B–42B (FIG. 1).

In FIG. 10, there is shown a plan view of a fixture 152 for forming a wire panel, which is a subassembly in the preferred embodiment of the bottom of the ball and bat carrier, having a base 159, a center slot 160, main wire grooves 178 and 180 and finger wire grooves generally indicated at 162A–162I. The center slot 160 exposes the junctions between a central main wire in the bottom of the ball and bat carrier and the finger wires that form the fingers 86A–86K (FIG. 1). There are fewer fingers in the embodiment of FIGS. 10–12 than there are in the embodiment of FIG. 1. The main wire and the finger wires are welded together by electrode resistance as described in FIG. 13. At either end of the center slot 160 are located main wire grooves 178 and 180 to hold the main wire in place.

To form the wire fingers as described in connection with FIG. 1, U-shaped wires are placed in each of the finger wire grooves located at 162A–162I to be welded to the main wire by the action of a resistance welder which contacts them in the center slot 160.

Each of the finger wire grooves 162A–162I includes a corresponding first wire groove 166A–166I and a corresponding second wire groove adjacent and parallel to the first groove indicated at 168A–168I. The first and second grooves are connected by a corresponding wire groove indicated at 170A–170I to form a U-shaped groove to hold the U-shaped wires which form hook members of the game section. Alternate ones of the grooves 162A–162I extend across the base 159 to provide greater support to the bottom of the ball and bat carrier while the other alternate grooves terminate at the center wall.

In FIG. 11, there is best shown the main wire groove 178 which holds the main wire in place within the center slot 160 to receive electrodes which enter the slot 160 at 182 and 184.

FIG. 12 is a rear elevational view of the base 159 which best shows the finger grooves 166A–166I and 168A–168I and the main wire grooves 178 and 180.

In FIG. 13, there is shown an electric resistance welder 150 and the fixture 152 positioned for relative motion between the two so as to weld wires in the fixture together electically using an amperage in the range of between 1,000 ampere momentary demand and 40,000 ampere momentary demand. With this embodiment, fixtures of sub-assemblies such as the hook assemblies and side assemblies are held in place and welded and then the entire group of sub-assemblies is brought together and welded leaving a holder of entirely wire and relatively light weight and compact. In the preferred embodiment, the fixture is moved between electrodes 154 and 156 which are moved into contact with opposite sides of the wire joint to be welded.

For this purpose, at least 50% of the total lengths of all of the wires combined have a diameter in the range of ⅛" to ½" and at least 80 percent by weight of the entire holder is made entirely of wires. The wires may be purchased from any fabricator of wires and consists of circles, rectangles and straight members, with the straight members being bent to form hooks or the like where necessary or purchased in that manner. A suitable vendor is Better Wire Products, Inc. located at 1255 Niagara Street, Buffalo, N.Y. 14213.

As can be understood from the above description, the bat and ball holder of this invention is light in weight, easily balanced, and economically constructed. It is suitable for securely storing bats and balls and moving them to a ballpark and may be positioned at the ballpark for easy removal of such items by hanging it on a fence or the like.

While a preferred embodiment of the invention has been described with some particularity, many modifications and variations in the preferred embodiment are possible without deviating from the invention. Therefore, it is to be understood, that within the scope of the appended claims, the invention may be practiced other than as specifically described.

What is claimed is:

1. A ball and bat carrier comprising:

a framework at least 80 percent of which is wires welded together and having a total wire length;

the total wire length including at least one-half of wire having diameters within the range of ⅛ inch to ½ inch;

said framework including a ball holder section, a bat storage section and a bat game rack section;

said framework including two hook members extending outwardly a length of between ½ inch and 5 inches having downwardly extending portions within a range of ½ inch to 5 inches and being positioned above the center of gravity of the wire framework, whereby said ball and bat rack may be hung on a fence, for use during a game in a position that causes the game bat rack to be readily accessible;

said framework further including means serving as a handle when carrying and ending above the top of the framework in a hand grip portion and a bottom upon which the rack may rest;

said ball holder section including wire members shaped at the top end to receive a ball and having members extending downwardly to confine a stack of balls, the top having a dimension across it within the range of 1½ inches to 5 inches;

said hand grip portion of the handle being at least three inches long;

the distance between the top of the hand grip portion and the handle and the bottom of the framework being less than 36 inches and more than 12 inches;

the distance between the bottom of the hand grip portion and the top of the framework being at least three quarters of an inch.

said ball holder section having at the bottom a support to hold balls and above the support a wider portion within the range of $1\frac{1}{4}$ inches to $3\frac{1}{2}$ inches;

said bat storage section including means for holding bats in a horizontal position from right to left with the grip portion of the bat being supported on one end and the thickened portion of the bat on the other.

2. A ball and bat carrier according to claim 1 further including wire fingers extending outwardly horizontally from the ball and bat carrier and having slots between them whereby the shanks of bats may be rested there upon.

3. A ball and bat carrier according to claim 2 including first and second ball holders in said ball holder section;

a general storage area shaped substantially as a right regular parallelopiped;

said general storage area being adapted to receive a storage container;

said first and second ball holders being positioned on opposite sides of said general storage area;

said carrying handle positioned near the top of the general storage area;

the general storage area having a width of between 3 and 8 inches, a length of between 8 and 36 inches and a height of between 8 and 24 inches.

4. A ball and bat carrier according to claim 3 in which:

said first and second hooks are positioned near the top of the storage area above the center of gravity of the rack when its top is positioned upwardly;

said game bat rack holder fingers being positioned near the bottom of the storage area below the center of gravity;

said game bat rack fingers being wire loops extending vertically outwardly and spaced apart from each other a sufficient distance to receive the grip portion of a bat and close enough to be supported upon the flange at the bottom of the grip portion of a bat;

said support members having a width at least twice the distance the flange of the bat extends outwardly from the grip portion;

said supports being formed to parallel wires defining between them the support area and a joining member defining the end of the support;

said distance between game bat rack flingers being between $\frac{3}{4}$ and $2\frac{3}{4}$ inches and the finger support surfaces being in the range of $\frac{1}{4}$ and 2 inches.

5. A ball and bat carrier according to claim 4 in which the means for holding bats in a horizontal position includes a plurality of interacting vertical members and horizontal members;

the space between adjacent vertical members being between 2 and $4\frac{1}{2}$ inches.

the space between certain of the adjacent horizontal members being between 2 and $4\frac{1}{2}$ inches, whereby holders are formed for receiving the thick portions of baseball bats;

certain of the horizontal members having hook members on their ends able to hold the grip portion of a baseball bat.

6. A ball and bat carrier according to claim 5 in which the hook members have a radius of ourvature of a diameter of between 0.75 and 3 inches and extend outward from one of the posts in the range of $\frac{3}{4}$ inches to $2\frac{3}{4}$ inches;

7. A ball and bat carrier according to claim 6 further including vertical posts in a vertical plane that makes an angle of 56 degrees with the vertical plane of the sides of the ball and bat rack and between $\frac{1}{2}$ and $1\frac{1}{2}$ inches from certain of the vertical posts, whereby the bats are restrained from sliding from the ball and bat rack when stored.

8. A method of making a ball and bat holder comprising the steps of:

obtaining curved simple-shaped wire objects and linear simple-shaped wire objects with the wire being between $\frac{1}{8}$ inch in diameter and $\frac{1}{2}$ inch in diameter;

said step of obtaining including the step of obtaining straight portions of wire having diameters in the range of $\frac{1}{8}$ inch in diameter to $\frac{1}{2}$ inch in diameter;

placing a plurality of said curved and linear simple-shaped wire objects in a fixture together in one plane;

welding joining connections of the curved and linear simple-shaped wire objects while it is in the fixture with a resistance welder using an amperage of between 1,000 ampere momentary resistance and 40,000 ampere momentary resistance at the junctions of the wires, whereby a first panel is formed;

welding a second panel;

welding said linear simple-shaped wire objects about said curved simple-shaped wire objects with said resistance wires, whereby a framework is formed.

9. Apparatus for making a ball and bat holder comprising:

means for holding a plurality of said linear simple-shaped wire objects in a fixture in one plane together with one of said curved simple-shaped wire objects;

means for welding joining connections of said curved and linear simple-shaped wire objects while it is in the fixture with a resistance welder using an amperage of between 1,000 ampere momentary resistance and 40,000 ampere momentary resistance at the junctions of the wires, whereby first panel is formed;

means for welding a second panel; and means for welding said linear simple-shaped wire objects about said curved simple-shaped wire objects with said resistance wires, whereby a framework is formed.

10. A ball and bat carrier comprising:

a framework at least 80 percent of which is wires welded together and having a total wire length;

the total wire length including at least one-half of wire having diameters within the range of $\frac{1}{8}$ inch to $\frac{1}{2}$ inch;

said framework including a ball holder section, a bat storage section and a bat game rack section;

said framework including two hook members extending outwardly a length between $\frac{1}{2}$ inch and 5 inches having downwardly extending portions within a range of $\frac{1}{2}$ inch to 5 inches and being positioned above the center of gravity of the wire framework, whereby said ball and bat rack may be hung on a fence, for use during a game in a position that causes the game bat rack to be readily accessible;

said bat storage section including means for holding bats in a horizontal position from right to left with the grip portion of the bat being supported on one end and the thickened portion of the bat on the other; and wire fingers extending outwardly horizontally from the ball and bat carrier and having slots between them whereby the shanks of bats may be rested thereupon.

* * * * *